United States Patent [19]

Wallsten

[11] 4,125,641

[45] Nov. 14, 1978

[54] METHOD FOR APPLYING A COATING COMPOSITION ONTO A MOVING PAPERWEB

[75] Inventor: Hans I. Wallsten, Lausanne, Switzerland

[73] Assignee: Inventing S.A., Lausanne, Switzerland

[21] Appl. No.: 622,494

[22] Filed: Oct. 15, 1975

[30] Foreign Application Priority Data

Oct. 16, 1974 [SE] Sweden ..... 7413068

[51] Int. Cl.[2] ..... B05D 3/00

[52] U.S. Cl. ..... 427/296; 118/50; 118/410; 427/345; 427/356; 427/358

[58] Field of Search ..... 427/345, 356, 296; 118/50, 410, 411

[56] References Cited

U.S. PATENT DOCUMENTS

| | | | |
|---|---|---|---|
| 3,024,129 | 3/1962 | Brundige | 427/345 |
| 3,029,161 | 4/1962 | Ferner | 427/345 |
| 3,113,884 | 12/1963 | Kohler | 427/356 |
| 3,158,498 | 11/1964 | Carpenter | 427/356 |
| 3,179,536 | 4/1965 | Martinek | 427/356 |
| 3,192,895 | 7/1965 | Galer | 118/410 |
| 3,329,523 | 7/1967 | Best et al. | 427/345 |
| 3,470,848 | 10/1969 | Dreher | 118/429 |
| 3,474,757 | 10/1969 | Dreher | 118/411 |
| 3,502,494 | 3/1970 | Ishiwata et al. | 118/411 |
| 3,533,834 | 10/1970 | Marzocchi | 427/296 |

FOREIGN PATENT DOCUMENTS 562,776 9/1958 Canada.

*Primary Examiner*—Ronald M. Smith
*Assistant Examiner*—Sadie L. Childs
*Attorney, Agent, or Firm*—Lerner, David, Littenberg & Samuel

[57] ABSTRACT

A method for applying a coating composition onto a moving paper web, in which the web is supplied with an excess of said coating composition. The web is passed tightly over a lower slot in a container, which by means of vacuum, is kept filled with the coating composition. A flexible blade is arranged to remove the excess coating composition and to uniformly regulate the final thickness of the coating and said removed excess coating is recirculated to the container for further use.

2 Claims, 3 Drawing Figures

METHOD FOR APPLYING A COATING COMPOSITION ONTO A MOVING PAPERWEB

BACKGROUND OF THE INVENTION

1. Field of Invention

This invention pertains to paper web coating systems and more particularly to a coating system for applying a coating composition onto a paper web.

2. Description of the Prior Art

According to a known method a moving web is treated with liquid by passing the web tightly over an opening in a container connected to a liquid supply and to a vacuum source so that the vacuum is maintained in said container and the liquid is drawn by said vacuum up over said opening, thus reaching the web. Attempts have also been made to arrange a further opening, which could be divided into one or more rows of holes, in this known container and furthermore a horizontal rod bas been placed longitudinally across said row of holes. This arrangement has been used to remove excess liquid from the web when passing said rod due to the vacuum in said container. However this removed excess liquid is recirculated to the lower part of the container containing fresh liquid to be supplied to the web.

This known device may be used for treating paper webs with water, surface glue in the form of a starch solution and other liquids having low viscosity. The advantage of this known system is that it is compact and that if the web breaks because wetting is performed under vacuum, only a small quantity of the liquid will be spilled.

In producing coated paper for the use as printing paper at least one side of the paper web is coated with a suspension containing pigments, for example clay in water. Those suspensions for coating compositions genrally also contain a number of chemical additives, such as binders, dispersing agent etc. The water content in that coating composition is partly absorbed during the coating of the web and simultaneously a filter cake of pigment is built up on the surface of the web. After this coating operation the web is passed through suitable drying means so that the absorbed water is caused to evaporate either entirely or partially.

This necessary evaporation step not only affects the ultimate costs of the finished product due to the very nature of the coating process, but also requires that the coating be performed with a coating composition which is as dry as possible. It has recently been established that blade-coating systems are highly recommendable for coating compositions having a high dryness content. Such blade-coating systems comprises a thin, flexible blade arranged to press the web against a backing surface, such as a rotating roller, and thereby smoothing the applied coating composition evenly over the web and at the same time remove the excess coating composition from the web. These known techniques also have the advantage of enabling very high speed to be used for such systems because, due to the high dryness content of the composition, the relatively minor quantity of water can be evaporated without using large drying equipment. It has been found that coating compositions with dryness contents of between 55–60 percent by weight of dry substance could be used in such blade coating systems, but even higher dryness contents are mainly used.

SUMMARY OF THE INVENTION

In accordance with the teachings of the present invention there is provided a coating method and apparatus having a wider operating range than said conventional device. In addition, generally higher coat weights may be applied to the web than with conventional equipment, and coating materials having a wider range of solid contents of pigment may be used. Be being able to use coating materials having varying characteristics and properties and by being able to selectively change the operating condition of the coater, a wider range of high quality coated products can be produced. Generally the method employed with applicants coating system comprises the steps of

- passing the web tightly over a lower slot in a container which, by means of vacuum, is kept filled with the coating composition to a level positioned about the upper edge of said lower slot;
- applying an amount of coating composition in excess of that required for the final coating to the surface of the web;
- passing the coated web over a flexible blade to remove the excess coating composition and to uniformly regulate the final thickness of the coating; and
- recirculating said removed excess coating to the container through an upper slot in said container.

As compared with the above known coating apparatus using a rod as a doctoring mechanism, the use of a thin flexible blade results in a wide variety of high quality coated papers which can be produced under selected operating conditions of the apparatus.

DESCRIPTION OF THE PREFERRED EMBODIMENTS

Figure 1:
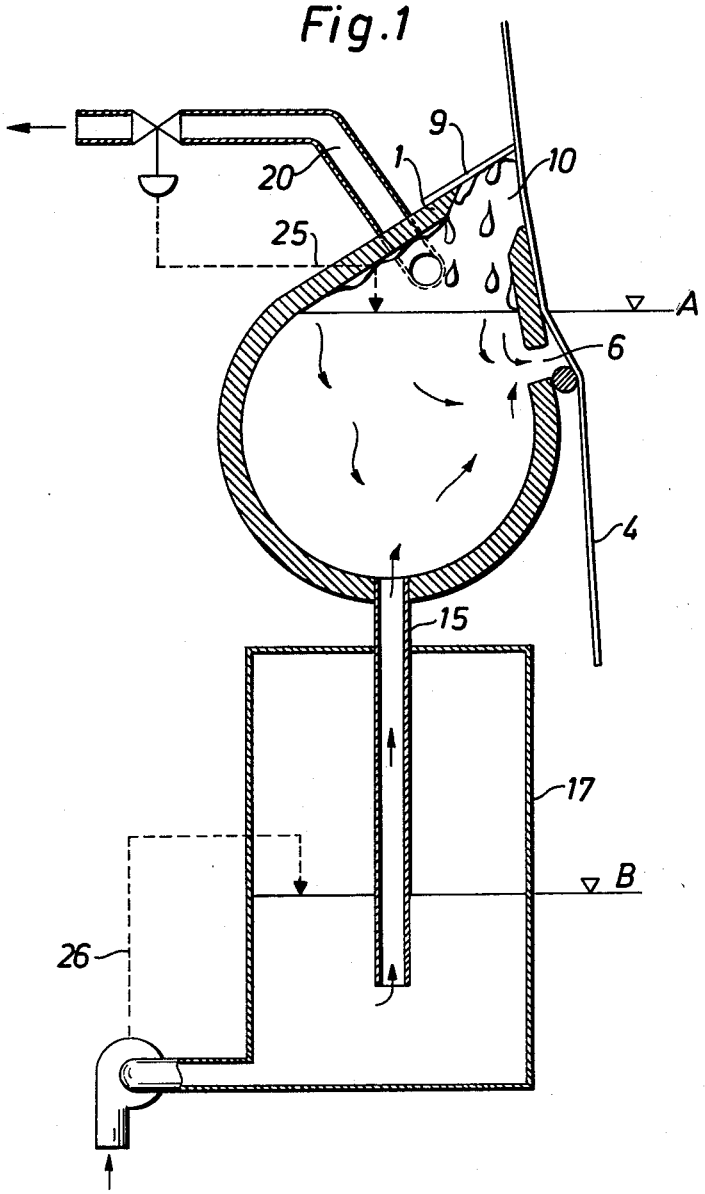
FIG. 1 is a principle view of the improved coating system of the present invention.

As shown in FIG. 1 the coating apparatus of the present invention generally comprises a container 1 being connected to a vacuum source by means of a conduit 20. The coating composition is thus fed to the container 1 through a pipe 15 from a container 17 having connection to the air and in which a constant liquid level B is maintained by means of a regulating means 26 adjusting the supply of said composition to the container. The coating composition is supplied to a paper web 4 through a lower row of holes or a slot 6 in said container 1. A predetermined liquid level A is maintained in said container 1 by a regulating means 25 and this level A is positioned above the slot 6. The container 1 is further provided with an upper vacuum slot 10 positioned above said liquid level A and the upper extent of said slot 10 is formed by a blade 9. Due to the vacuum in the conduit 20 the amount of removed excess coating composition could be regulated and said removed excess coating composition from the web is thus fed back down to the container. The blade 9 is adjustable in relation to the web 4 by suitable adjustment members, not shown.

A considerable improvement in the uniformity of the coating layer has been obtained by using the apparatus shown in FIG. 1 and it has been found that the final thickness of the applied coating of the paper web could easily be adjusted.

However, when using coating compositions having dryness contents over 40–50% certain problems could arise with the equipment shown in FIG. 1 after some time. These problems appear to have a tendency to increase the drier the composition is and entail variations in the quantity of the composition smooth during the coating process.

A closer study of the problem of variations in the thickness of the final coating indicates that these variations are caused by the removed excess coating composition which obviously is drier than the fresh coating composition contained in said container 1. The water content in the excess coating composition is lower because a certain quantity of water has been absorbed in the paper web 4. The thickened removed excess coating composition, which is recirculated to the bottom part of the container 1, will be mixed with the fresh coating composition and, as mentioned above, causes difficulties in regulating the quantity of coating by means of the vacuum making it very difficult to entirely eliminate the above mentioned variations.

Figure 2:
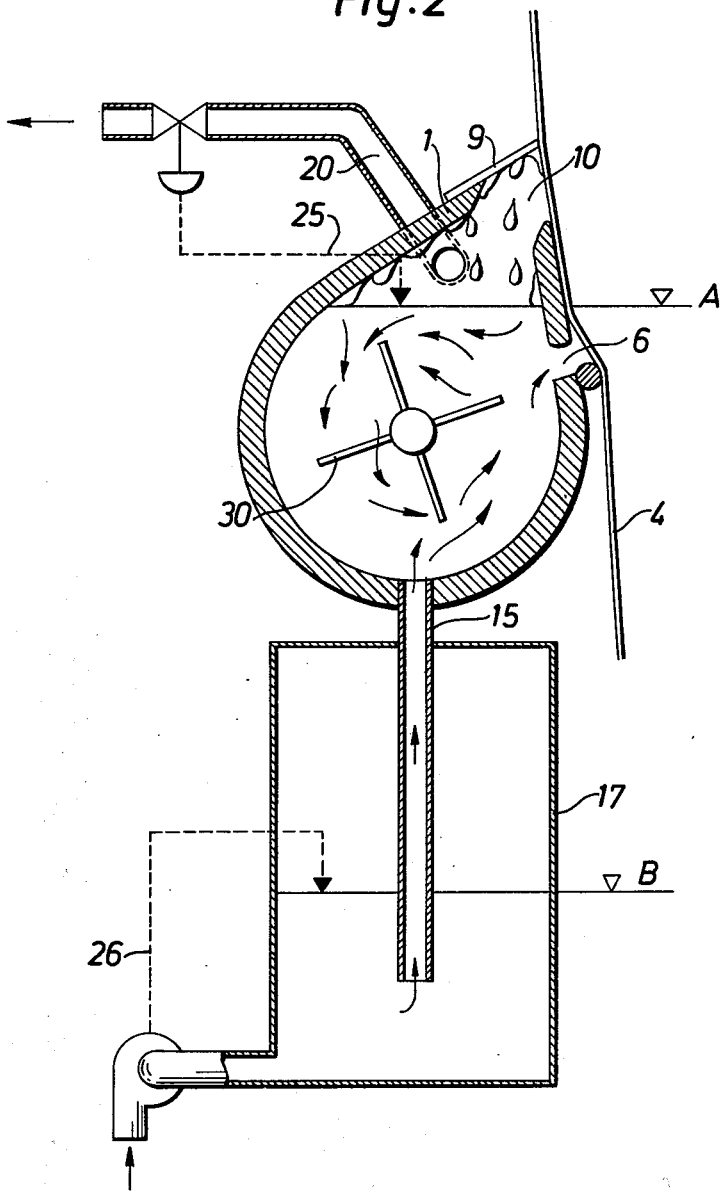
FIG. 2 shows a further embodiment of the improved coating system of the present invention.
Figure 3:
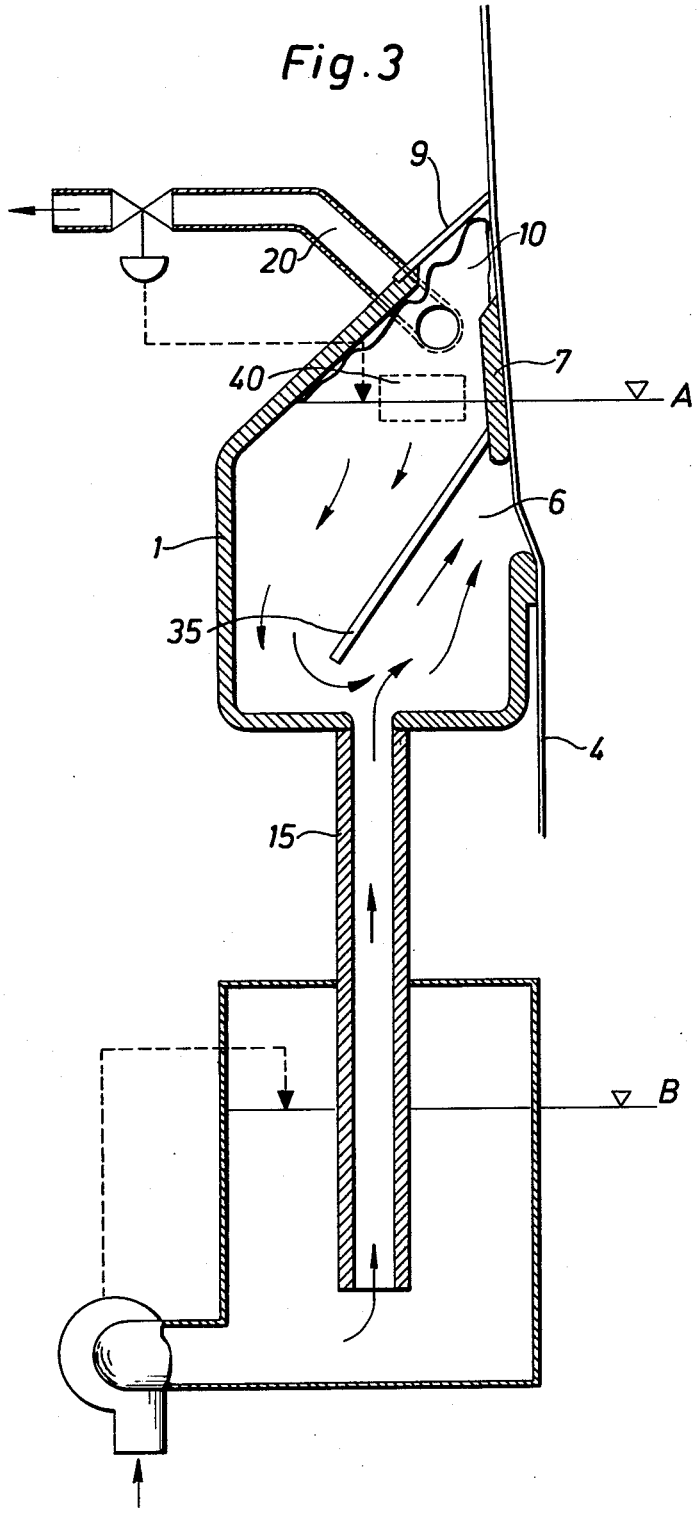
FIG. 3 shows a further embodiment of the improved coating system of the present invention.

It has now been possible to eliminate these problems causing undesirable variations in the final thickness of the coating composition by using equipments shown in present FIGS. 2 and 3.

The apparatus shown in FIG. 2 is generally identical to that shown in FIG. 1, but is furthermore provided with a member 30 arranged to effect a stirring of the coating composition in the container 1. By this procedure the fresh coating composition applied from the storage container 17 and the excess coating composition removed from paper web 5 can be thoroughly mixed within container 1. As a result, the problem of the thickening composition in that container is eliminated to a great extend. Stirring member 30 may either be caused to rotate by the action of the coating composition running into the container over the pipe 15 or said member may be driven by a drive means not shown, located outside the container.

Another embodiment of the present invention is shown in FIG. 3 for obtaining a uniform mixing of the removed excess coating composition and the supplied fresh coating composition in the container 1. In this equipment an oblique wall 35 has been arranged in the container 1. The wall 35 is arranged in such a way as to be tightly sealed to the wall-section 7 formed between the upper edge of the dispensing slot 6 and the lower edge of the removal slot 10. At its lower end the wall forms a gap extending across the entire width of the container. The width of the gap is such that suction force is produced by the fresh coating compound entering the container from below and thereby effecting a mixing with the removed excess coating composition.

In order to achieve a uniform result across the entire width of the web, the fresh coating composition is suitably supplied to the container 1 from below via a supply means which is extends across the entire width of the web.

A means 40 shown in broken lines in FIG. 3 indicates an opening for removal of foam which may be formed on the surface of the coating composition.

The above description of the present invention has been made with particular reference to the presently preferred embodiments; however, it is to be understood that various changes thereto may be made without departing from this scope of the invention as set forth in the following claims.

I claim:

1. A method of applying a coating composition to a paper web of indeterminate length, which method totally eliminates the need for passing the web between a backing roller and an applicator, comprising the steps of:

providing an applicator housing having spaced apart upper and lower slots each of said slots having upper and lower edges extending across the width of the web being coated;

providing a source of coating composition communicating with the interior of said housing;

drawing said web across both of said slots and moving the web in a direction transverse to the long dimension of the slots so that the web moves generally upwardly;

scraping excess composition from the web as it passes the upper end of the upper slot with a flexible scraping member;

maintaining a vacuum in the interior of said housing which vacuum condition is of a magnitude sufficient to draw coating composition from said source into said housing and to draw the portion of the web moving across the upper slot into more intimate engagement with said upper slot and to maintain the level of coating composition in said housing above the upper edge of the lower slot and below the lower edge of the upper slot to cause an excess amount of coating composition to be dispensed through said lower slot and upon said web, whereby the coating composition is smoothed as the web passes over the upper flexible edge of the upper slot and excess composition is returned directly to and combined with the coating composition presently in said housing.

2. The method of claim 1 further comprising the step of continuously circulating the coating composition in the applicator housing to admix the coating composition returned to the housing through the upper slot with the circulating composition and thereby provide a more uniform mixture of composition in said housing.

* * * * *